US012123667B2

(12) United States Patent
Markut et al.

(10) Patent No.: US 12,123,667 B2
(45) Date of Patent: Oct. 22, 2024

(54) BOLT CATCH FOR A FIREARM

(71) Applicant: GLOCK TECHNOLOGY GMBH, Ferlach (AT)

(72) Inventors: Karl Markut, Klagenfurt (AT); Mario Kastrun, Maria Rain (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 174 days.

(21) Appl. No.: 17/756,920

(22) PCT Filed: Dec. 11, 2020

(86) PCT No.: PCT/EP2020/085755

§ 371 (c)(1),
(2) Date: Jun. 6, 2022

(87) PCT Pub. No.: WO2021/116405

PCT Pub. Date: Jun. 17, 2021

(65) Prior Publication Data

US 2023/0003482 A1 Jan. 5, 2023

(30) Foreign Application Priority Data

Dec. 13, 2019 (EP) ..... 19215965

(51) Int. Cl.

| | |
|---|---|
| ***F41A 17/36*** | (2006.01) |
| ***F41A 3/66*** | (2006.01) |
| ***F41A 3/72*** | (2006.01) |
| ***F41A 35/06*** | (2006.01) |

(52) U.S. Cl.

CPC ..... *F41A 17/36* (2013.01); *F41A 3/66* (2013.01); *F41A 3/72* (2013.01); *F41A 35/06* (2013.01)

(58) Field of Classification Search

CPC .... F41A 17/36; F41A 3/66; F41A 3/72; F41A 35/06

See application file for complete search history.

(56) References Cited

U.S. PATENT DOCUMENTS

| | | | | |
|---|---|---|---|---|
| 8,261,652 | B2 | 9/2012 | Findlay | |
| 9,810,493 | B2 | 11/2017 | Fluhr et al. | |
| 9,958,223 | B1 | 5/2018 | McGinty | |
| 10,197,353 | B2 | 2/2019 | Lewis et al. | |
| 11,512,920 | B1 * | 11/2022 | Oglesby | F41A 17/42 |

(Continued)

FOREIGN PATENT DOCUMENTS

| | | | |
|---|---|---|---|
| DE | 10008979 | A1 | 9/2001 |
| DE | 102012019422 | B3 | 4/2014 |
| JP | S61127911 | A | 6/1986 |

OTHER PUBLICATIONS

International Search Report for PCT/EP2020/085755; established Apr. 12, 2021.

*Primary Examiner* — J. Woodrow Eldred
(74) *Attorney, Agent, or Firm* — Raven Patents, LLC; Anton E. Skaugset

(57) ABSTRACT

A bolt catch lever for a firearm, including receivers and associated elements for receiving the bolt catch lever. In particular, a bolt catch lever comprising an upper lever arm, a lower lever arm, and a center element including a catch which is designed so as to be pivotable about a pivot axis in a lower receiver, where the center element has a recess for optionally receiving a connection section of a second bolt catch lever.

20 Claims, 7 Drawing Sheets

(56) References Cited

U.S. PATENT DOCUMENTS

| | | | | |
|---|---|---|---|---|
| 11,536,531 | B1 * | 12/2022 | Geissele | F41A 3/68 |
| 2010/0251591 | A1 | 10/2010 | Burt et al. | |
| 2014/0338243 | A1 | 11/2014 | La Vigne | |
| 2015/0323271 | A1 | 11/2015 | McGinty | |
| 2016/0282070 | A1 | 9/2016 | William et al. | |
| 2017/0284761 | A1 | 10/2017 | Lewis et al. | |

* cited by examiner

BOLT CATCH FOR A FIREARM

FIELD OF THE INVENTION

The disclosure relates generally to firearms, in particular to bolt catches for firearms, and more particularly to bolt catches that can be adapted for ambidextrous use.

BACKGROUND

In multi-shot weapons, and in particular self-loading weapons, bolt catch devices, which are referred to in the following simply as bolt catches, are very widespread. In the context of this present disclosure, a bolt is understood, in a simplified manner, to mean a slide or bolt carrier which receives at least one bolt head, also often referred to as a bolt support. The bolt catch is primarily used, when the last cartridge has fired, to catch the bolt in a defined position while advancing and to hold it open. In this case, the bolt catch is usually triggered via a tactile projection or bolt catch finger by means of a defined edge, bulge or the like on the follower of the magazine, if said finger protrudes at least in part from the top of the magazine after the last cartridge has been fired.

However, it may also be necessary for the shooter to manually hinder the advancement of the bolt. This can be the case, for example, during the disassembly process or if it is necessary to manually interrupt the automatic firing process.

In the context of this application, reference is often simply made to a bolt, with the bolt in the selected drawings and the description primarily describing the arrangement and characteristics of a bolt carrier together with a bolt head received therein, as can be used compatibly with AR-style firearms, i.e. M4/M16/AR15 rifles. The loading and closing processes for rifles of this kind are well known to a person skilled in the art, and therefore the process is only briefly discussed here.

The bolt carrier is moved forward by the closing spring, commonly referred to as the buffer spring, in a known manner when the bolt is closed, the rotatable bolt head being locked by means of locking lugs in the barrel extension or directly in the barrel, while the reverse process takes place automatically after a shot has been fired by tensioning the closing spring, or takes place during manual loading by actuating the charging handle.

After the last shot has been fired, the bolt is automatically caught by the interaction of the magazine follower and the spring-loaded bolt catch. Following a magazine change, the actuating element of the bolt catch, which is usually arranged on the left-hand side of the receiver, can be manually operated by the shooter, whereby the bolt carrier is released again and the closing process can be completed.

In recent years, a large number of bolt catches that can be actuated on both sides of a receiver have been developed in order to ensure the possibility of simple operation for right-handed and left-handed shooters alike. Reference should be made here to U.S. Ser. No. 10/197,353 B2, U.S. Pat. No. 9,958,223 B1, U.S. Pat. No. 8,261,652 B2, and U.S. Pat. No. 9,810,493 B2 (each incorporated by reference for all purposes), which all have substantially the same basic shape and mode of operation of the "left-hand" actuating element.

In U.S. Ser. No. 10/197,353 B2, the right-hand actuation of the bolt catch is carried out by a right-hand actuating element which translates the movement to the left-hand actuating element by means of a lever and a cam. In order to receive the right-hand actuating element, a cavity, guide and mount for the upper receiver that are provided specifically for this purpose are required, which means that it is not usually possible to retrofit this bolt catch into existing AR-style firearms.

A similar approach is pursued in U.S. Pat. No. 8,261,652 B2, wherein the right-handed actuation is deflected via a fork-shaped recess for a protrusion of the left-hand lever. This design substantially requires a receiver provided in advance in order to be able to receive the bolt catch in corresponding cavities.

Another approach is explained in U.S. Pat. No. 9,958,223 B1, which shows a bolt catch lever that can be operated on both sides. The lever on the left-hand side from the point of view of the shooter has a cavity in its center element, which cavity is designed to have a protrusion of the right-hand lever in order to cooperate in the manner of a toggle lever. Two biasing means and two separate lever axes are required, which makes it difficult to retrofit an existing AR-style firearms or requires a lower receiver designed for this purpose.

Lastly, U.S. Pat. No. 9,810,493 B2 discloses a bolt catch lever which is suitable for ambidextrous operation and in which the two actuating levers are integrally formed, so that the entire bolt catch lever is in one piece. The right-hand and left-hand actuation can be carried out about a common tilt axis. The use of a bolt catch lever of this kind requires a slight modification to the receiver.

A number of multi-part bolt catch arrangements are therefore known to a person skilled in the art, all of which require more or less difficult adaptation of the lower receiver of an AR-style firearm in order to enable ambidextrous operation. In particular, it is often difficult to retrofit existing AR-style firearms with an ambidextrous bolt catch. A person skilled in the art also knows at least one one-piece bolt catch which can be operated on both sides of the receiver and which also requires a minor modification to the lower receiver in order to retrofit an existing weapon for ambidextrous operation of the bolt catch.

In certain cases, however, it may be necessary to provide a bolt catch on both sides, such as for weapon exercises, training, etc., and to subsequently adapt said bolt catch to the needs of the shooter. In this specific case, this can also mean that the shooter might wish to refrain from operating the bolt catch on the right-hand side after using an ambidextrous bolt catch for exercise purposes. With the known bolt catches, conversion is extremely time-consuming and in some cases, due to the arrangement of the bolt catch levers, not even possible without an appropriate tool. This means that it may not even be possible to adapt the bolt catch lever in the field of application. Moreover, in the case of receivers of AR-style firearms that are specially designed for bolt catches that can be operated on both sides, an opening remains at least on one side of the receiver when a conventional bolt catch that can be operated on one side is used. However, such openings are generally undesirable because they allow foreign bodies such as sand, dust and water to penetrate.

What is needed therefore is a bolt catch which is easy to manufacture and operate, which allows ambidextrous operation and which, if necessary, can be dismantled back to a one-sided bolt catch. It would be particularly advantageous if such a bolt catch can be implemented in existing AR-style receivers with as little effort as possible. It would also be preferred if the bolt catch made it more difficult for undesired foreign bodies to penetrate into the receiver.

SUMMARY

The present disclosure relates to a bolt catch that can be adapted for ambidextrous use for firearms, in particular for AR-style firearms, i.e. M4/M16/AR15 rifles. The present disclosure also relates to a receiver for receiving the bolt catch, as well as means for reducing the penetration of foreign bodies into the receiver and for simplifying operability. The disclosed bolt catch and its variants are not limited to rifles, carbines, etc., but can in principle also be used for pistols.

In one aspect, the present disclosure is directed to a bolt catch lever for a firearm, the bolt catch lever including an upper lever arm, a lower lever arm, and a center element coupled to the upper lever arm and the lower lever arm, the center element comprising a catch which is designed so as to be pivotable about a pivot axis in a lower receiver of the firearm, where the center element defines a recess for optionally receiving a connection section of a second bolt catch lever.

In another aspect, the present disclosure is directed to a firearm receiver including a lower receiver for receiving a first bolt catch lever, the first bolt catch lever including an upper lever arm; a lower lever arm; and a center element coupled to the upper lever arm and the lower lever arm, the center element having a catch which is designed so as to be pivotable about a pivot axis in the lower receiver; and a second bolt catch lever configured to be received in the first bolt catch lever; where the second bolt catch lever includes a connection section which can be form-fittingly connected to a recess defined by the first bolt catch lever; where the lower receiver has a bolt catch receptacle which is continuous in a transverse direction and can optionally be closed on a right-hand side.

BRIEF DESCRIPTION OF THE DRAWINGS

The bolt catch of the present disclosure is explained in greater detail with reference to the drawings. In the drawings, shown schematically.

DETAILED DESCRIPTION

Figure 1:
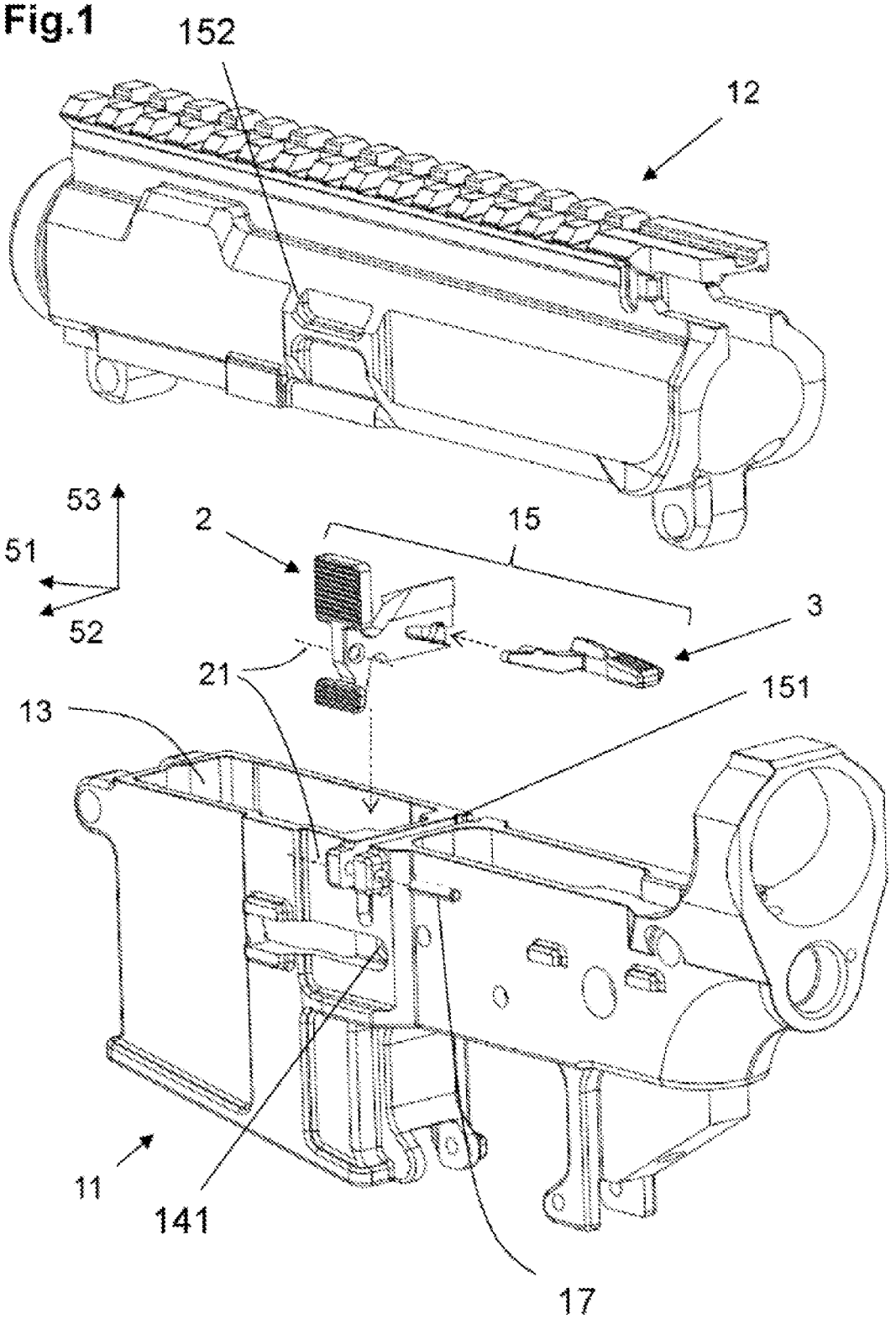
FIG. 1 is a perspective exploded view of a lower receiver together with a bolt catch shown above, and an upper receiver.

The bolt catch lever, or first bolt catch lever, of the present disclosure, which can be pivoted about a pivot axis, has a center element comprising an exemption, or recess, which can be used for optionally receiving a second bolt catch lever. The recess is substantially complementary in shape to a connection section of the second bolt catch lever.

A first bolt catch lever designed in this way offers the advantage of temporarily attaching a second, optional bolt catch lever, which can be easily inserted into the recess of the first bolt catch lever. As a result of the recess, the second bolt catch lever can be partially received by the first bolt catch lever in such a way that, viewed in the barrel direction, the connection section to be inserted does not protrude beyond the original dimensions of the center element of the first bolt catch lever. This makes it possible to easily insert the first bolt catch lever according to the present disclosure into an existing receiver of an AR-style firearm. If the second bolt catch lever is intended to be installed, only one opening in the bolt catch receptacle of an existing receiver is required on the "right-hand" receiver wall, as viewed from the viewpoint of the shooter. A bolt catch receptacle of this kind, which is continuous in the transverse direction, is relatively simple to produce by machining, for example by milling or broaching, or in extreme cases even by means of a file. Ideally, a receiver designed according to the present disclosure is provided, as described later.

In other cases, it may be desirable to only use a bolt catch lever which can be operated on the right-hand side and has a modified geometry, such as an extended operating element and/or a different shape. In this case too, the solution according to the present disclosure enables the left-hand, first bolt catch lever to be left in the lower receiver and a correspondingly shaped, second bolt catch lever to be exchanged relatively easily.

A bolt catch lever is usually arranged on the lower receiver so as to be pivotable between a rest position, in which a catch of the bolt catch is arranged outside the movement path of the bolt in the lower receiver, and a working position, in which the bolt catch blocks the bolt in its movement path.

With the present concept, it has proven to be advantageous if the recess of the first bolt catch lever is designed in such a way as to, in the rest position and the working position, at least partially cover the connection section of the second bolt catch lever with the lower receiver. In this way, the risk of an unintentional release of the second bolt catch lever from the recess can be effectively reduced in a relatively simple manner.

The recess of the first bolt catch lever is arranged in the center element, preferably on the rear face, i.e., counter to the barrel direction. The recess can preferably be substantially groove-shaped and extends laterally and/or underneath such that, in the assembly position, the connection section of the second bolt catch lever can be received but, in the rest position and/or the working position, the second bolt catch lever can project from the receiver on the right-hand side.

A bolt catch lever usually has a lower lever arm which, when the bolt catch is activated, either manually or as a result of an empty magazine for example, is used as a stop on the lower receiver. According to the present disclosure, however, it is particularly advantageous if the lower and/or upper receiver and the first bolt catch lever are optimized for the use of the two-part bolt catch device according to the present disclosure.

In this case, the lower lever arm of the first bolt catch lever and/or the mount or the stop on the lower receiver can be designed in such a way that the first bolt catch lever can be pivoted into a third position for the installation or removal of the second bolt catch lever when the upper receiver is opened or removed. This third position is called the assembly/disassembly position. In this case, it is advantageous if the recess is correspondingly arranged on the center element in order to, in the disassembly position, release the connection section of the second bolt catch lever for the installation or removal of the second bolt catch lever.

According to the present disclosure, the installation/removal of the second bolt catch lever can thus be carried out in a very simple and tool-free manner. The second bolt catch lever is simply pushed into the first bolt catch lever substantially from "behind."

In particular cases, it can be advantageous if the recess in the center element of the first bolt catch lever, which recess is used to receive the second bolt catch lever, defines an additional bearing recess which widens the first recess (or exemption) at least in the barrel direction. In this way, an additional contact surface for the connection section or the second bolt catch lever can be formed on the first bolt catch lever, whereby any transverse forces, e.g., when rotating or tilting the second bolt catch lever, can be absorbed in the first bolt catch lever even more effectively. This can significantly reduce the risk of the second bolt catch lever jamming within the bolt catch receptacle. It is correspondingly advantageous to provide, on the connection section of the second bolt catch lever, a bearing portion which is substantially complementary in shape to the bearing recess.

Further possible embodiments of the bolt catch according to the present disclosure offer corresponding possibilities for attaching the second, optional bolt catch lever so as to be optimally positioned for the shooter and/or the possibility for mounting said lever with as little loss as possible.

Some further aspects according to the present disclosure deal with possible adaptations of the upper and/or lower receiver, as well as the use of an optional plug to minimize the bolt catch against the undesired penetration of foreign bodies, in particular sand, dirt and dust, into the receiver. These aspects relate, inter alia, to a receiver for receiving the bolt catch, a grip part, receiver or shaft comprising a cavity for temporarily storing the unrequired second bolt catch lever and/or a plug. In summary, these aspects should be understood as a means for reducing the penetration of foreign bodies, but can also be used as a means for limiting the deflection of the first bolt catch lever in the cases described.

Throughout the description and the claims, "in front of" or "forward" is used as the direction toward the muzzle of the barrel, "back(ward)" is used as the direction toward the shaft, "down(ward)" is used as the direction for the bolt toward the magazine, and "up(ward)" is used as the direction away from the magazine. The terms "weapon central plane," "bore axis," "barrel axis," "bore," etc. have the usual meaning assigned thereto in the prior art by a person skilled in the art. "Left" is thus related to the weapon central plane, "from the left" corresponds to a movement, actuation, or exertion of force in the direction of the weapon central plane, proceeding from a starting position "to the left" thereof, etc. Accordingly, the bolt or the bolt carrier is moved "backward" under the effect of the gases after a shot is fired and moves "forward" again under the action of a closing spring, etc.

In the context of the present disclosure, a bolt catch device which is suitable for arrangement in a firearm, preferably an AR-style firearm, is designated by reference sign "15" and simply referred to in the following as a bolt catch.

In the figures of the drawings, an attempt was made to designate everything that relates to the receiver 1 with "1 n," as well as using "2n" for the first bolt catch lever according to the present disclosure, using "3n" for the second bolt catch lever, "4n" for the bolt carrier, and "5n" for the coordinate system relative to the receiver for orientation.

FIG. 1 is a schematic exploded view of a two-part receiver 1, it being possible to receive a magazine (not shown) in a magazine well 13 provided for this purpose in the lower receiver 11. Furthermore, a magazine release aperture 141 is shown in the lower receiver 11, in which aperture a magazine release 14 can be installed in a known manner. Above the magazine release aperture 141, the bolt catch receptacle 151 for the bolt catch 15 can be seen, as well as protrusions which are formed so as to protrude laterally on the lower receiver 11 and are intended for receiving the pivot pin 17. Said pin 17 is inserted into the protrusions in the barrel direction 51 along the pivot axis 21 in order to fix the bolt catch 15 so as to be deflectable to a certain extent.

Figure 6:
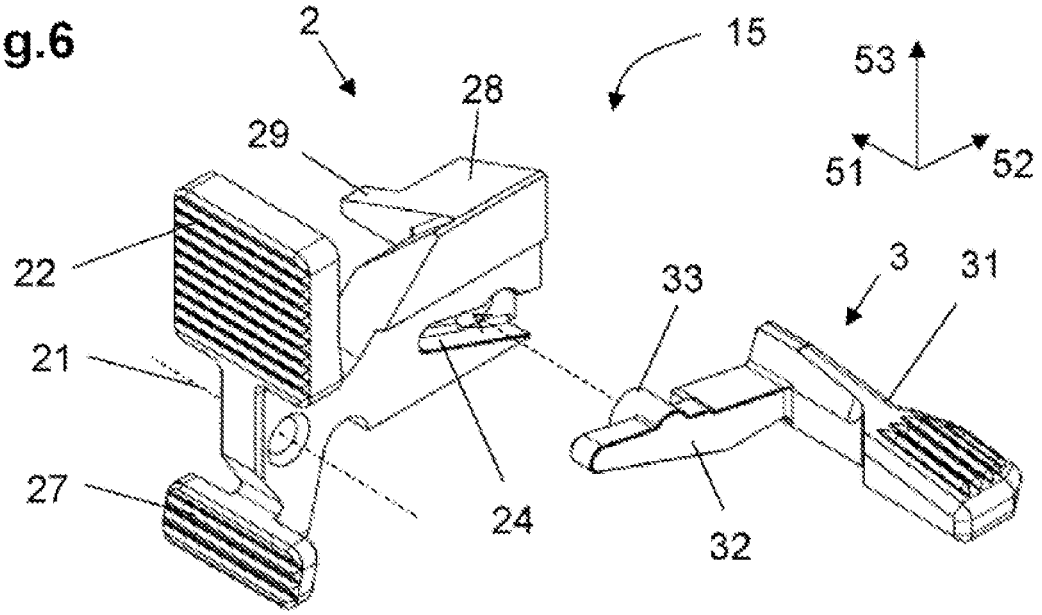
FIG. 6 is an exploded view from "obliquely behind" of an exemplary bolt catch.

Furthermore, it can be seen in FIG. 6 that the first bolt catch lever 2 has a recess 24 in order to receive, if required, a second bolt catch lever 3 by pushing or inserting it therein.

In the installed state, the first bolt catch lever 2 projects at least partially from the receiver 1 leftward in the transverse direction 52, as can be clearly seen in all of FIGS. 3 to 5. FIG. 1 also shows a useful measure according to the present disclosure for protecting against unintentional actuation and/or becoming stuck on the first bolt catch lever 2, or its upper and/or lower lever arm 22 or 27, in the form of a bolt catch curb 152. This curb 152 is designed to protrude with respect to the upper receiver 12 and, in the installed state, thus forms a type of lateral delimitation of the upper lever arm 22.

Figure 9A:
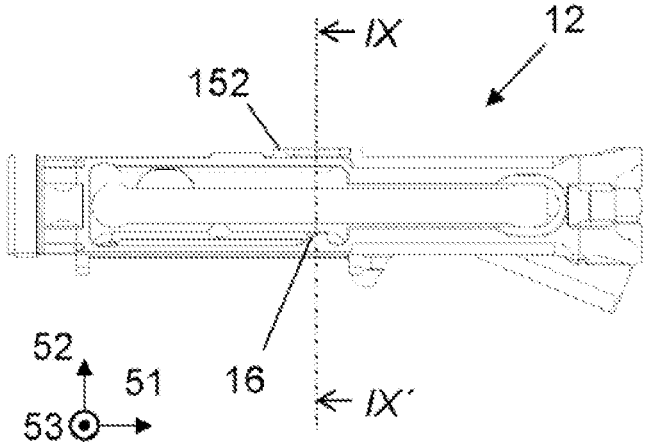
FIG. 9A shows a view from below of an exemplary upper receiver.
Figure 9B:
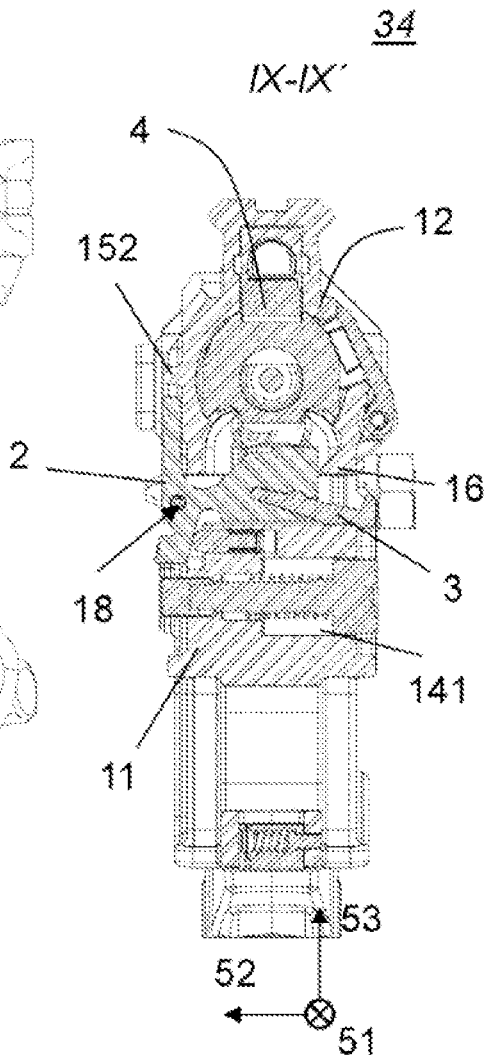
FIG. 9B shows a cross section along the line IX-IX' from FIG. 9A.
Figure 9C:
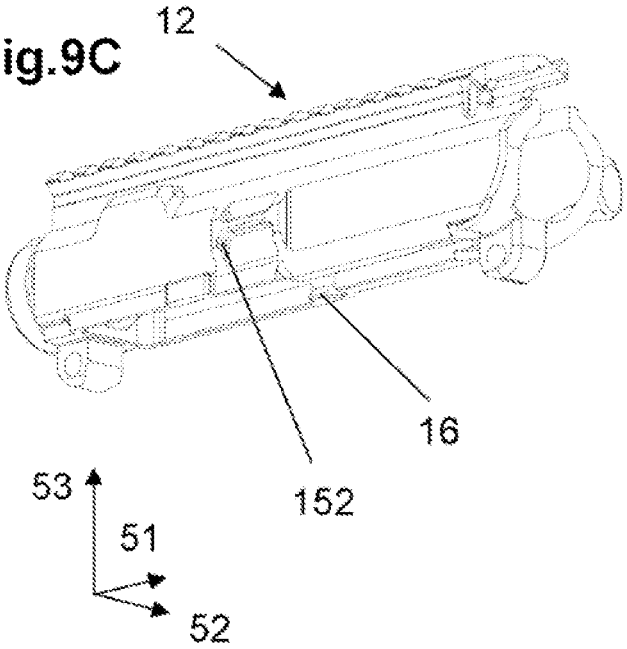
FIG. 9C shows an upper receiver in a view from obliquely "below"

In a preferred variant, this bolt catch curb 152 is designed to protrude at the same height with respect to the upper receiver 12 as the upper lever arm 22 in the rest state (cf. FIG. 9C). In other words, these two elements 152 and 22 are preferably substantially at the same level with respect to the upper receiver 12, it naturally also being possible for the bolt catch curb 152 to be slightly lower.

In a further particularly preferred variant, the bolt catch curb 152 substantially has an "H" shape. This means that the curb 152 can be designed to protect the upper lever arm 22 not only at the bottom in the vertical direction 53 but also at the top, whereby a shaded region is created. This region can be used, for example, to attach a number, such as a registration code, a weapon serial number or even a logo, and is largely protected against mechanical abrasion by the curb 152.

Figure 2:
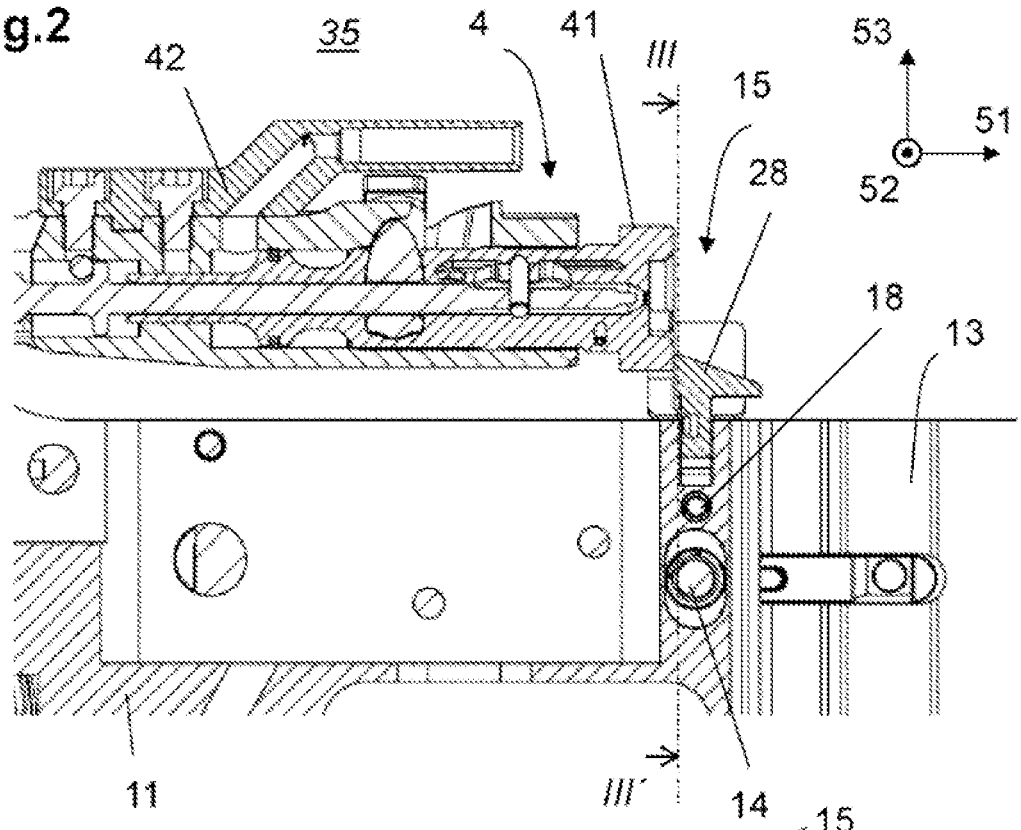
FIG. 2 shows a detail of a sectional view through the weapon central plane with a bolt which is held by the bolt catch.

The operating principle of the bolt catch 15 is shown schematically in FIG. 2, which shows a section through the weapon central plane with a bolt carrier 4. While advancing, the bolt carrier 4 is blocked in a known manner on the bolt head 41 by the bolt catch 15 or its catch 28. A gas key 42 can also be seen on the bolt carrier 4, which gas key 42 is only shown for the sake of orientation.

Figure 3A:
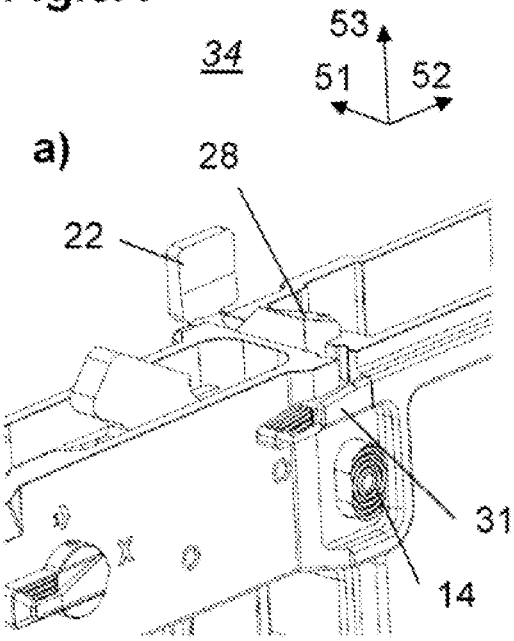
FIG. 3A is an oblique view of the bolt catch in the lower receiver in the rest position.
Figure 3B:
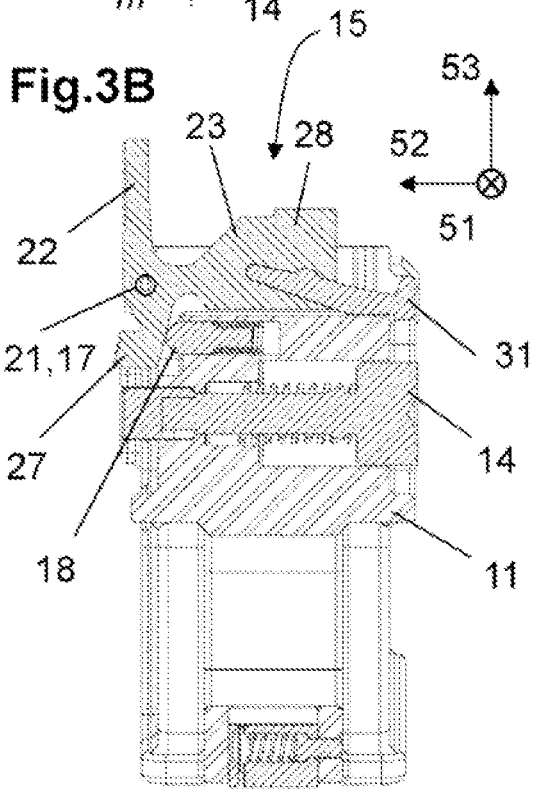
FIG. 3B is a cross-sectional view, corresponding to FIG. 3B, along the line III-Ill' from FIG. 2.
Figure 4A:
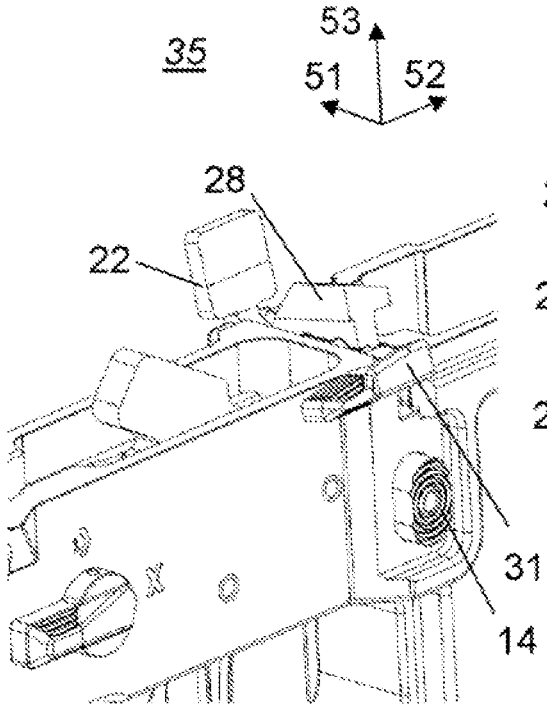
FIG. 4A is an oblique view of the bolt catch in the lower receiver in the working position.
Figure 4B:
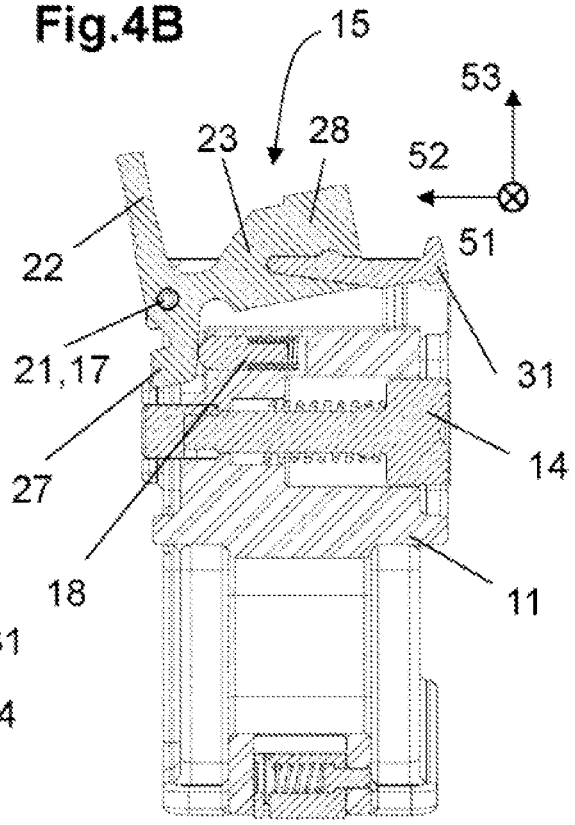
FIG. 4B is a cross-sectional view, corresponding to FIG. 4A, along the line III-Ill' from FIG. 2.

Upon closer inspection of FIG. 2 in conjunction with FIGS. 3A and 3B, as well as FIGS. 4A and 4B, it becomes clear that the bolt catch 15 according to the present disclosure requires only one pivot axis 21 in a known manner and is held in its rest position 34 (FIGS. 3A and 3B) by means of a biasing means 18. If the lower lever arm 27 on the first bolt catch lever 2 is now manually actuated or if the second lever arm 31 is manually deflected upward, or if the previously described deflection of the bolt catch finger 29 on the catch 28 is carried out by the follower of a magazine after the last cartridge, the first bolt catch lever 2 is tilted about the pivot axis 21 against the pretensioning force of the biasing means 18 into the active position or working position 35 (FIGS. 4A and 4B). For the sake of simplicity, FIGS. 3A to 5B do not show the upper receiver 12.

Upon closer inspection of FIGS. 3A to 5B, it can be seen that, when pivoting or tilting into the working position 35, the lower lever arm 27 does not strike the lower receiver 11 in the embodiments shown. This can be made possible either by a correspondingly designed lower lever arm 27 or by a correspondingly optimized lower receiver 11. When the upper receiver 12 is open, or when the upper receiver 12 is removed, it is possible for the first bolt catch lever 2, or the entire bolt catch 15, to tilt into an assembly or disassembly position 36; see in this respect FIGS. 5A and 5B. The disassembly position 36 is thus reached when the first bolt catch lever 2 is deflected to such an extent that the second bolt catch lever 3 can be removed from the recess 24.

As is clearly visible in FIGS. 4A and 4B and is easily conceivable when viewed together with, e.g., FIG. 9B, the assembled bolt catch 15 can only assume the working position 35 during operation, since the second bolt catch lever 3 on the upper receiver 12 is limited to an overdeflection into the disassembly position 36. Furthermore, it can be clearly seen in FIG. 4B that the second bolt catch lever 3 protrudes obliquely from the center element 23 and its second lever arm 31 protrudes from the receiver 1. In this embodiment, the recess 24 and the corresponding connection section 32 are arranged in such a way that, in the working position 35, the respective tops are therefore aligned with the top of the bolt catch receptacle 151, which can reduce the risk of the second bolt catch lever 3 falling out unintentionally.

Figure 5A:
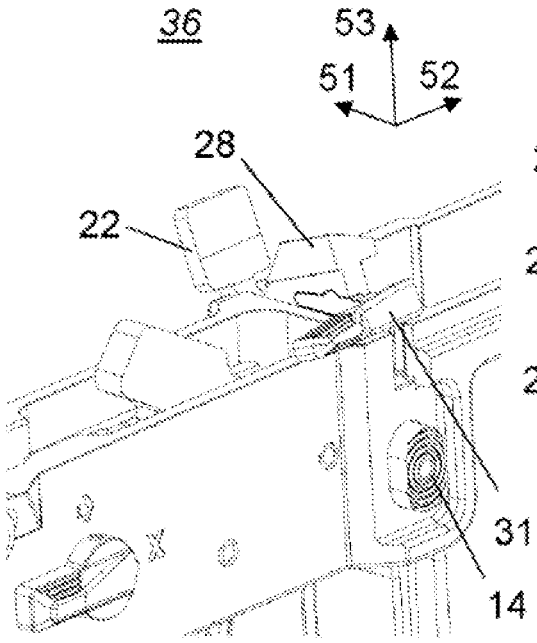
FIG. 5A is an oblique view of the bolt catch in the lower receiver in the assembly/disassembly position.
Figure 5B:
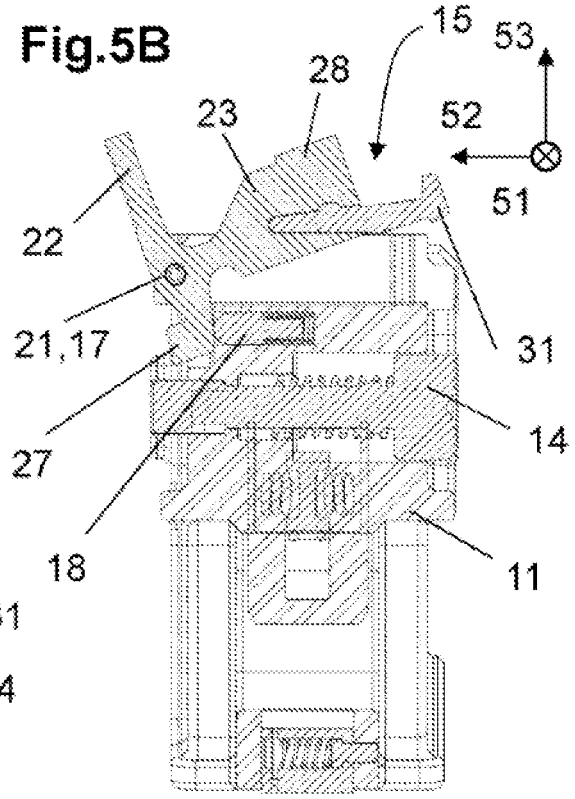
FIG. 5B is a cross-sectional view, corresponding to FIG. 5A, along the line III-Ill' from FIG. 2.

In the disassembly position 36 first shown by way of example in FIGS. 5A and 5B, the respective bottoms of the recess 24 and the corresponding connection section 32 are aligned with the upper edge of the bolt catch receptacle 151, which makes removal possible. The configuration of the fit or the play of the bolt catch 15 within the bolt catch receptacle 151 can be optimized by a person skilled in the art with little effort on the basis of the present disclosure.

There are a wide variety of possibilities for the design of the bolt catch 15 according to the present disclosure, some of which are mentioned here by way of example. As is clearly visible in FIG. 1 in conjunction with FIGS. 6, 7 and, the first and second bolt catch levers 2, 3 are matched to one another in such a way that a form-fitting connection is possible. The center element 23 of the first bolt catch lever 2 in this case has a recess (or also exemption) 24, which is preferably designed to be at least partially open at the rear. For a person skilled in the art, it is apparent from the present description that the recess 24, and/or any bearing recesses 25, etc., can also be formed at the front in the barrel direction 51. For the sake of brevity, a detailed description is not given for these analogous cases. This recess 24 can be, for example, in the form of a groove, which does not necessarily have to be parallel but can also extend obliquely, as shown, or in a different shape. The second bolt catch lever 3 provided for insertion into the center element 23 has a connection section 32 which is correspondingly complementary in shape, in order to form a form-fitting connection, at least in the region of the recess 24, after insertion into the first bolt catch lever 2. This connection is thus relatively easily detachable, and as a result it is possible to easily dismantle the bolt catch 15 from ambidextrous to single-sided operation.

Figure 7:
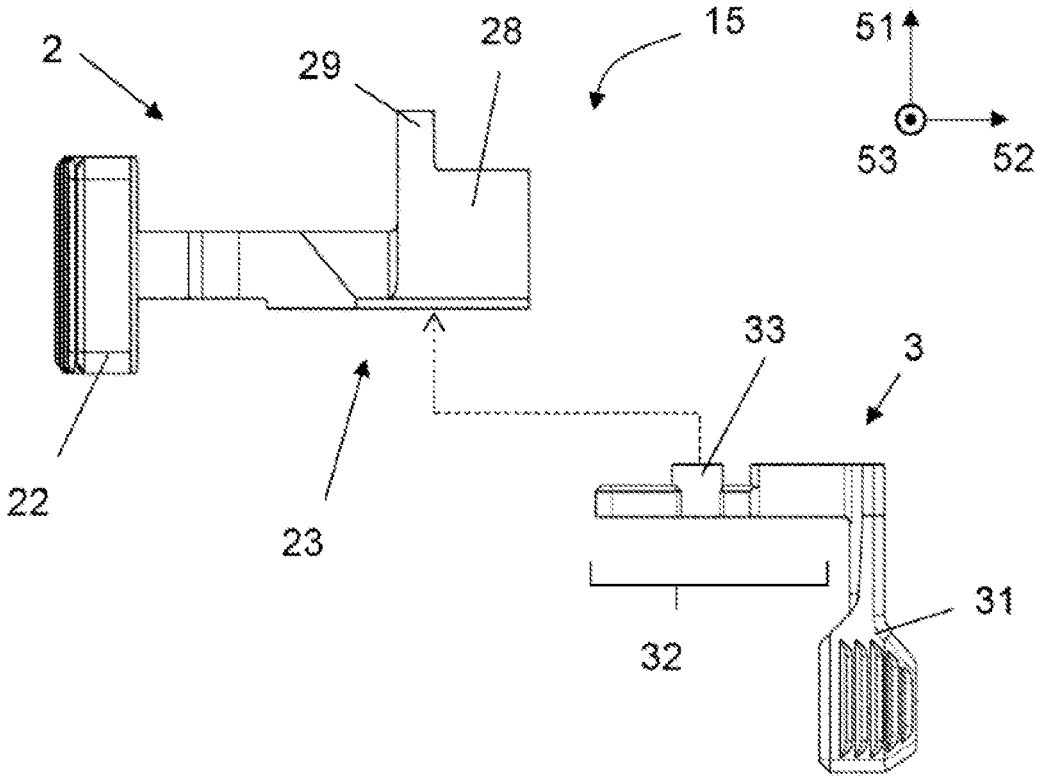
FIG. 7 is a plan view of an exemplary bolt catch.

As can be clearly seen from FIGS. 6 and 7 together, it is possible to form at least one bearing protrusion 33 so as to protrude on the connection section 32, which bearing protrusion 33 interacts with an additional bearing recess 25 defined by the recess 24 on the center element 23. The connection section 32 is designed, mutatis mutandis, in the same way as the previously described design of the recess 24. In this way, rotation of the second bolt catch lever 3 about the vertical direction 53 or normally to the barrel direction 51 can be reduced to a minimum and the risk of the bolt catch 15 jamming in the bolt catch receptacle 151 can be reduced.

From the oblique view in FIGS. 6 and 7, it is also possible to clearly see the direction of insertion and the complementary shape of the recess 24 and the connection section 32. It can also be seen that the second lever arm 31 can be angled and/or bent relative to the connection section 32, whereby the positional stability and the space requirement of the bolt catch 15 in the receiver 1 can be optimized. In addition, this measure can accordingly make the handling of the actuating element projecting on the right-hand side easier.

Figure 8A:
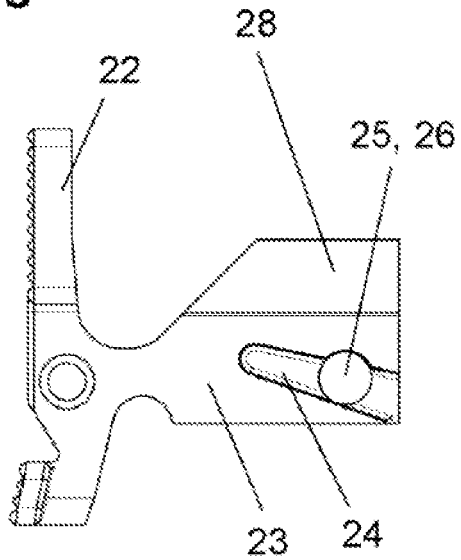
FIGS. 8A and 8B are views from "behind" and "obliquely behind" of exemplary bolt catch levers.
Figure 8B:
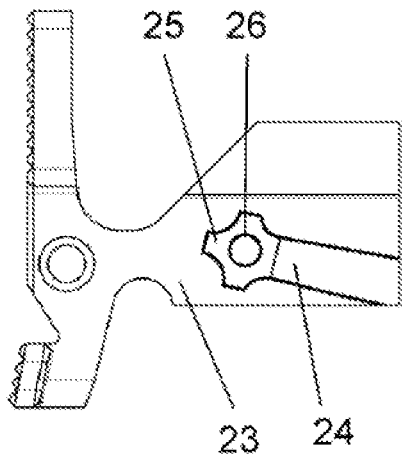
Figure 8B:
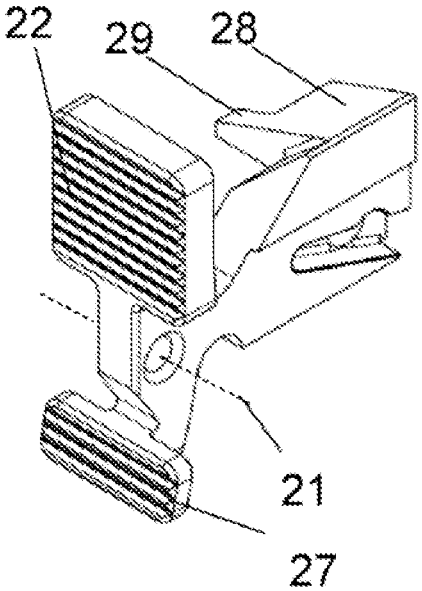
Figure 8B:
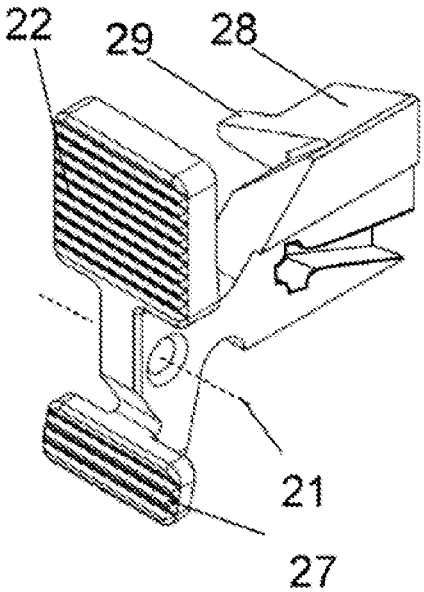

FIGS. 8A and 8B each show embodiments of a first bolt catch lever 2 in a view from behind (upper drawings) and in corresponding oblique views (lower drawings). It can be clearly seen that the first bolt catch lever 2, as is common in the prior art, has a larger upper lever arm 22 and a somewhat smaller lower lever arm 27. The common pivot axis 21 is usually designed as a through-bore and can receive a pivot pin 17 or a spring pin or the like. A catch 28 is formed on the center element 23 toward the front, i.e., in the assembly position in the barrel direction 51, which catch blocks the movement of the bolt carrier 4 toward the front when the first bolt catch lever 2 tilts upwards (cf. FIG. 2). A bolt catch finger 29 is formed on the catch 28 and cooperates in a known manner with the feeder of the magazine.

A further preferred embodiment is shown in FIGS. 8A and (B, according to which the recess 24 has a bearing recess 25 which is used to contact the bearing protrusion 33 of the second bolt catch lever 3. As can be seen from the figures, it is advantageous if the recess 24 has a widened portion in at least one spatial direction in order to receive the connection section 32 that is complementary in shape or its bearing protrusion 33. The choice and design freedom of the shape, such as a clover or crossed shape and the like, of the corresponding elements is the responsibility of a person skilled in the art.

In certain cases it can be advantageous if the recess 24 has a bearing hole 26 in one or more places, as shown in FIGS. 8A and 8. This bearing hole 26 is preferably an extension of at least part of a bearing recess 25 and, if necessary, allows pressure to be exerted on the connection section 32, which makes the disassembly process easier. In addition, the stepwise design of the recess 24 and/or the bearing recess 25 can be used for additional contact surfaces between the corresponding elements, whereby the torsional rigidity can be increased further.

FIG. 9A is a view from below of an isolated upper receiver 12 shown by way of example, FIG. 9B shows a cross section, along the line IX-IX' similar to FIG. 9A, on an exemplary firearm, and FIG. 9C is an isolated oblique view of the upper receiver 12 from FIG. 9A.

As explained at the outset, a further object of the present disclosure is to reduce the risk of penetration of foreign bodies into the receiver 1 as much as possible while still allowing relatively simple operability. This object can be achieved in several ways, which can be used individually or in combination. As shown in FIGS. 9A to 9C, it is possible to use an upper receiver 12 which has a cover protrusion 16 on its inside in the region of the bolt catch receptacle 151. This cover protrusion 16 is designed to protrude into the interior of the upper receiver 12 to such an extent that it does not hinder the movement of the bolt carrier 4 or the first bolt catch lever 2. Furthermore, contact with the cartridges of a loaded magazine should also be avoided. This situation can be seen very clearly in FIG. 9B, which, in conjunction with FIGS. 4A and 4B, shows that the bolt catch 15 can pivot freely to the left into the active position 35, but the cover protrusion 16, when the bolt catch 15 is in the rest position 34, significantly minimizes the gap between the upper receiver 12 and the center element 23 or catch 28 of the first bolt catch lever 2. In so doing, the penetration of foreign matter can be efficiently reduced. Furthermore, this cover protrusion 16 can be used as an additional measure to limit the tilting of the bolt catch 15 in the working position 35.

In order to further contribute to achieving the aforementioned objects, it is possible to adapt a lower receiver 11 of an existing firearm for the use of a bolt catch 15 according to the present disclosure. In such a case, the bolt catch receptacle 151 only needs to be widened to the right in the transverse direction 52 by an opening. It is easy to conceive that, when only the first bolt catch lever 2 is used, this opening remains and thus foreign bodies can penetrate.

In one particular embodiment, a plug 153 is provided which is used to temporarily close the right-hand opening in the bolt catch receptacle 151. As can easily be seen in FIG. 10, it is therefore possible to close the bolt catch receptacle 151 on the right-hand side if only the first bolt catch lever 2 is used.

Figure 10:
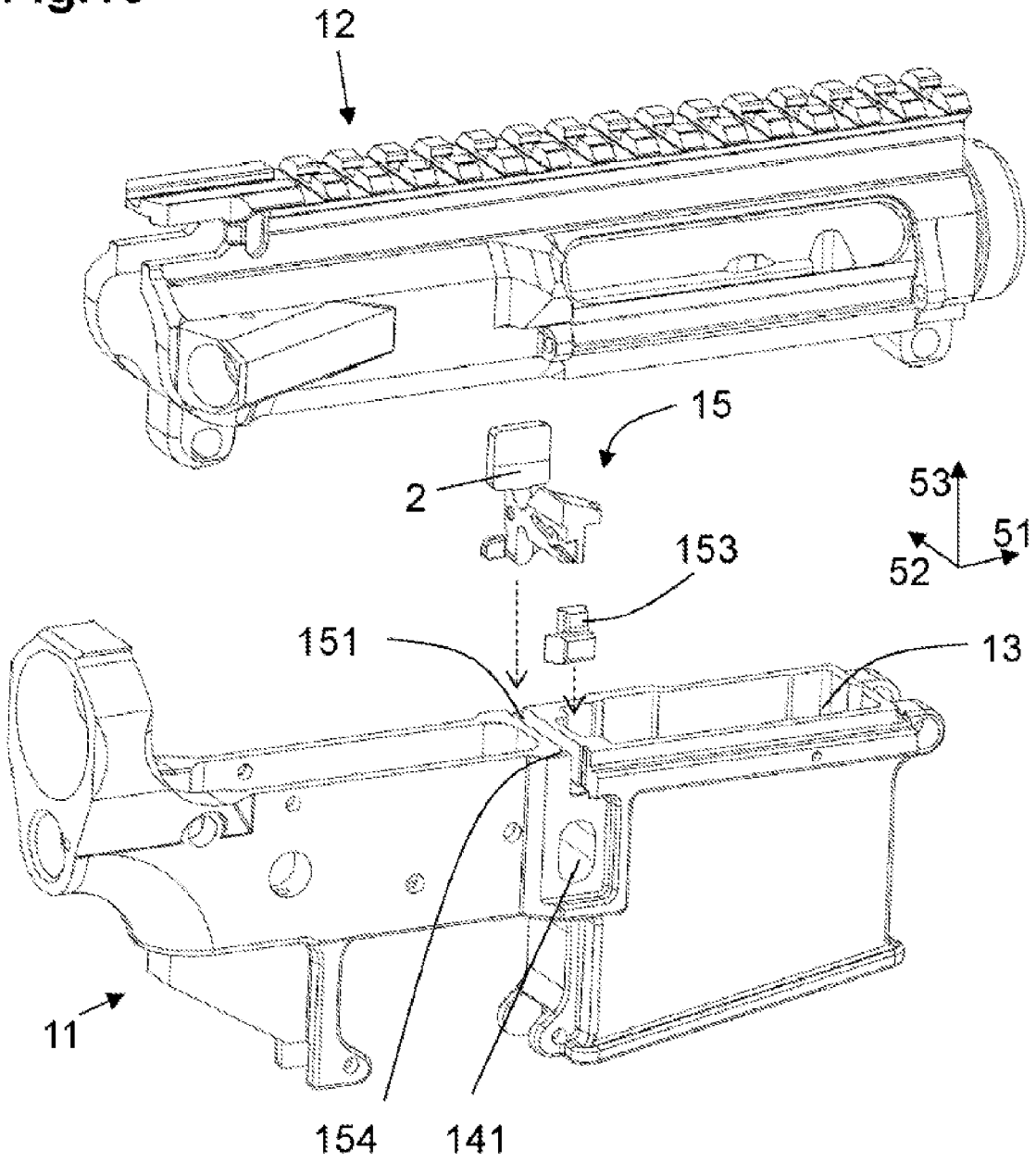
FIG. 10 is a perspective exploded view of a lower receiver together with a bolt catch and stopper shown above, and an upper receiver.

The bolt catch receptacle 151 is particularly preferably shaped on the right-hand side in the end region to accommodate the plug 153 and to minimize the risk of falling out unintentionally. As shown in FIG. 10, this can be achieved, for example, by means of fixation recesses 154, into which the plug 153 can be "inserted" or "introduced." In the example shown, the plug 153 is designed such that it can be inserted from above into the lower receiver 11 or into the corresponding fixation recesses 154. Once the weapon has been assembled with the plug 153, improved sealing of the receiver 1 is possible, even though a bolt catch 15 that can be operated on one side is used.

A plug 153 of this kind can be made of metal or preferably of an elastically deformable polymer, which is particularly beneficial for sealing.

Due to the relatively small dimensions of the second bolt catch lever 3 and/or the plug 153, said components can be "temporarily stored" in a cavity provided for this purpose in the receiver 1 or a shaft or grip part (not shown). The cavity of the receiver 1 can also have the same shape as the, e.g., lateral opening region of the bolt catch receptacle 151 comprising fixation recesses 154, for example in order to receive the plug 153. It is also possible for the cavity to have a similar shape to the recess 24 of the first bolt catch lever 2 in order to temporarily receive the second bolt catch lever 3. In this way, it is possible to convert from an ambidextrous to one-sided bolt catch 15, or vice versa, relatively quickly, since the required components always remain with the shooter or the firearm. In addition, such a holder is used to significantly reduce rattling caused by loose parts.

It is clear to a person skilled in the art that the embodiments shown were selected as schematic and/or exemplary representations and it is easily possible for a person skilled in the art to transfer the relationships according to the present disclosure to embodiments that have not been explicitly shown, and therefore these implicitly disclosed embodiments can be implicitly understood both in the description of the figures and in the claims.

List of Reference nos.

| | | | |
|---|---|---|---|
| 1 | Receiver | 27 | Lower lever arm |
| 11 | Lower receiver | 28 | Catch |
| 12 | Upper receiver | 29 | Bolt catch finger |
| 13 | Magazine well | | |
| 14 | Magazine release | 3 | Second bolt catch lever |
| 141 | Magazine release aperture | 31 | Secong lever arm |
| 15 | Bolt catch | 32 | Connection section |
| 151 | Bolt catch receptacle | 33 | Bearing protrusion |
| 152 | Bolt catch curb | 34 | Rest position |
| 153 | Plug | 35 | Active or Working position |
| 154 | Fixation recess(es) | 36 | Dis-/assembly position |
| 16 | Cover protrusion | | |
| 17 | Pivot pin | | |
| 18 | Biasing means | | |
| 2 | First bolt catch lever | 4 | Bolt carrier |
| 21 | Pivot axis | 41 | Bolt head |
| 22 | Upper lever arm | 42 | Gas key |
| 23 | Center element | | |
| 24 | Exemption/recess | 51 | Barrel direction |
| 25 | Bearing recess(es) | 52 | Transverse direction |
| 26 | Bearing hole | 53 | Vertical direction |

The invention claimed is:

1. A bolt catch lever for a firearm having a bolt, comprising:

an upper lever arm;

a lower lever arm; and a center element coupled to the upper lever arm and the lower lever arm, the center element comprising a catch for the bolt which is designed so as to be pivotable about a pivot axis in a lower receiver of the firearm;

wherein the center element defines a recess configured for reversibly receiving a connection section of a second bolt catch lever when the second bolt catch lever is installed;

wherein the recess and the connection section are complementary in shape; and when the second bolt catch lever is installed the bolt catch lever and the second bolt catch lever in combination are pivotable about the pivot axis.

2. The bolt catch lever according to claim 1, wherein the recess defined by the center element is designed in such a way that when the second bolt catch lever is installed, in a rest position and a working position, the connection section of the second bolt catch lever is at least partially covered by the lower receiver.

3. The bolt catch lever according to claim 1, wherein the recess is designed in such a way as to, when in a disassembly position, release the connection section of the second bolt catch lever for installation or removal of the second bolt catch lever.

4. The bolt catch lever according to claim 1, wherein the recess is substantially groove-shaped.

5. The bolt catch lever according to claim 1, wherein the recess further defines a bearing recess which widens the center element at least in or counter to a barrel direction of the firearm.

6. A bolt catch lever according to claim 5, wherein the bearing recess is designed as a bearing hole which passes at least in part through the center element in the barrel direction.

7. A bolt catch lever according to claim 1, further comprising a second bolt catch lever configured to be received in the bolt catch lever, wherein the second bolt catch lever has a connection section which can be form-fittingly connected to the recess of the bolt catch lever.

8. A bolt catch lever according to claim 5, further comprising a second bolt catch lever configured to be received in the bolt catch lever, wherein the second bolt catch lever has a connection section which can be form-fittingly connected to the recess of the bolt catch lever, and includes a bearing protrusion formed on the connection section.

9. A bolt catch lever according to claim 8, wherein the bearing protrusion has a greater longitudinal extension, at least in or counter to the barrel direction, than on a contact surface between the rest of the connection section and the recess.

10. A bolt catch lever according to claim 7, wherein the connection section, viewed transversely and/or normally to a barrel direction, is subsequently flush with the center element of the bolt catch lever.

11. A bolt catch lever according to claim 7, wherein the second bolt catch lever has a lever arm which, relative to the connection section, is angled and/or bent in at least one spatial direction.

12. A firearm receiver, comprising:

a lower receiver for receiving a first bolt catch lever, the first bolt catch lever including an upper lever arm;

a lower lever arm; and a center element coupled to the upper lever arm and the lower lever arm, the center element comprising a catch for a bolt which is designed so as to be pivotable about a pivot axis in the lower receiver; and a second bolt catch lever configured to be received in the first bolt catch lever; wherein the second bolt catch lever includes a connection section complementary in shape with, and configured to be form-fittingly connected to, a recess defined by the first bolt catch lever;

wherein the lower receiver has a bolt catch receptacle which is continuous in a transverse direction; and when the second bolt catch lever is received in the first bolt catch lever, the first bolt catch lever and the second bolt catch lever in combination are pivotable about the pivot axis.

13. The firearm receiver according to claim 12, further comprising a right-hand opening in the bolt catch receptacle to temporarily receive a plug in order to close the bolt catch receptacle.

14. The firearm receiver according to claim 13, wherein the plug is designed to temporarily close the right-hand opening in the bolt catch receptacle.

15. The firearm receiver according to claim 12, further comprising an upper receiver having a cover protrusion on its inside in a right-hand region of the bolt catch receptacle.

16. The firearm receiver according to claim 15, further comprising a bolt catch curb formed on the upper receiver, the bolt catch curb at least partially surrounding an upper lever arm of the first bolt catch lever when in an installed position.

17. The firearm receiver according to claim 16, wherein a height of the bolt catch curb is substantially the same as a level of the upper lever arm relative to the upper receiver.

18. The firearm receiver according to claim 16, wherein the bolt catch curb is substantially H-shaped.

19. A firearm, comprising a firearm receiver according to claim 13, wherein a grip part and/or a shaft of the receiver defines a cavity for receiving the second bolt catch lever and/or the plug.

20. The firearm receiver according to claim 13, further comprising a fixation recess complementary in shape to the plug and configured to temporarily receive the plug in order to close the bolt catch receptacle.

* * * * *